United States Patent [19]

Mizuno et al.

[11] 4,079,808

[45] Mar. 21, 1978

[54] TEMPERATURE SENSITIVE DEVICE FOR CAUSING ABNORMAL MUFFLER OPERATION

[76] Inventors: Kazutoshi Mizuno, No. 714, Nishiterao, Kanagawa, Yokohama; Iwao Nakamura, No. 3-33-17, Kishitani, Tsurumi, Yokohama, both of Japan

[21] Appl. No.: 625,100

[22] Filed: Oct. 23, 1975

[30] Foreign Application Priority Data

Nov. 12, 1974 Japan ..... 49-137001[U]

[51] Int. Cl.[2] ..... F01N 3/06

[52] U.S. Cl. ..... 181/237; 23/288 FA; 181/254; 236/93 R; 236/101 R

[58] Field of Search ..... 23/288 FA; 165/40; 181/37, 38, 45; 236/48 R, 93 R, 101 R, 101 E

[56] References Cited

U.S. PATENT DOCUMENTS

| | | | |
|---|---|---|---|
| 2,024,193 | 12/1935 | Watkins | 181/38 X |
| 2,157,030 | 5/1939 | Starkweather et al. | 181/45 |
| 2,833,479 | 5/1958 | Novesky | 181/45 X |
| 2,975,801 | 3/1961 | Kuypers et al. | 236/93 X |
| 3,083,084 | 3/1963 | Raymond | 181/45 X |
| 3,090,677 | 5/1963 | Scheitlin et al. | 181/45 X |
| 3,170,631 | 2/1965 | Whitlow | 236/93 X |
| 3,620,330 | 11/1971 | Hall | 181/45 |
| 3,841,841 | 10/1974 | Torosian et al. | 23/288 FA |
| 3,856,259 | 12/1974 | Doherty | 236/48 R |
| 3,930,613 | 1/1976 | Place | 236/48 R |

*Primary Examiner*—Lawrence R. Franklin

*Attorney, Agent, or Firm*—Robert E. Burns; Emmanuel J. Lobato; Bruce L. Adams

[57] ABSTRACT

When exhaust gases reach an abnormally high temperature, a bimetal valve opens and the muffler operates abnormally to produce a loud noise.

1 Claim, 9 Drawing Figures

TEMPERATURE SENSITIVE DEVICE FOR CAUSING ABNORMAL MUFFLER OPERATION

The present invention relates, in general, to an exhaust system for a combustion engine and more particularly to a device incorporated into the exhaust system which makes the vehicle driver aware of excessively high temperature exhaust gases. For discriptive ease this device will hereinafter be referred to as an alert or alarm device.

In order to eliminate the harmful components present in automotive exhaust gases, there have been proposed a variety of exhaust gas purifying devices such as a catalytic converter, a secondary air supplying device and a thermal reactor, in the exhaust system of a combustion engine. These devices have, however, some major disadvantages in that the temperature of the purifying devices are excessively increased because of the exothermic nature of the oxidation reaction within it. Accordingly, if unburned combustible gases from the engine are introduced into the gas purifying device due to the abnormal operation of the engine, the combustible gases burn rapidly in it. A remarkable amount of heat is thus liberated in the exhaust system and therefore not only the purifying device but also the exhaust system mounting devices, such as rubber mounts, will be destroyed by the heat. Further in severe cases, the heat becomes a serious danger to the vehicle and passengers.

Accordingly, it is an object of the present invention to provide means which can overcome the abovementioned drawbacks of the prior art.

Another object of the present invention is to provide inexpensive means which can make the vehicle driver aware of abnormally high temperature of the exhaust gases from the combustion engine.

An additional object of the invention is to provide an alert device which can cause the muffler to abnormally function in the event of excessive temperature thereby causing noticeably loud resonance noise to be heard.

The details as well as other objects and advantages of the present invention will be apparent from a perusal of the detailed description which follows.

Figure 6:
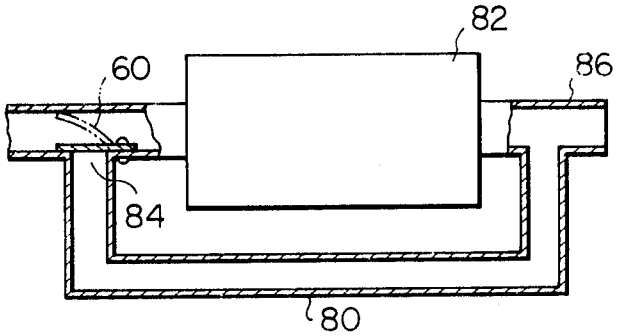

FIGS. *3a, 3b, 4a, 4b, 5a,* and *5b* are sectional views showing open and closed states of other bimetallic members, and FIG. 6 is a longitudinal sectional view of a second embodiment of the alert device according to the present invention.

Figure 1:
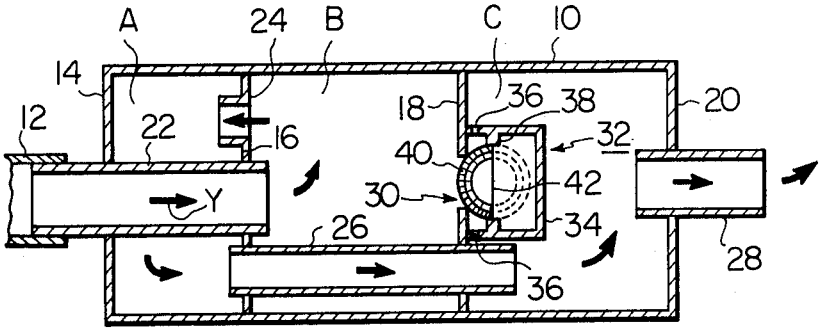
FIG. 1 is a longitudinal sectional view of a first embodiment of the alert device according to the present invention.
Figure 2:
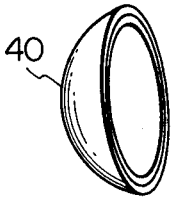
FIG. 2 is a perspective view of a dome-shaped bimetallic member employed in the device of FIG. 1.

Referring now to FIG. 1, there is shown an alert device of the present invention which has a muffler or casing 10 communicating with an exhaust gas purifying device (not shown) through an exhaust outlet tube 12. The casing 10 has therein three chambers A, B and C which are respectively defined by a front end wall 14 and a first partition wall 16, the first partition wall 16 and a second partition wall 18, and the second partition wall 18 and a rear end wall 20. Within the chamber A in parallel to a longitudinal axis of the casing 10 is positioned an inlet tube 22 which is supported by the front end wall 14 and the first partition wall 16. The inlet tube 22 has one end connected to the exhaust outlet tube 12 and the other end opening into the chamber B. At one portion of the first partition wall 16 is provided an orifice 24 which can provide communication between the chamber B and the chamber A. To provide a communication between the chamber A and the chamber C, an elongated tube 26 is arranged between the first partition wall 16 and the second partition wall 18 extending through the chamber B, in such a manner that the open both ends thereof open into the chambers A and C, respectively. Axially outwardly projected from a generally central portion of the rear end wall 20 is an outlet tube 28 which is used for emitting the exhaust gases within the chamber C into the open air.

In accordance with the present invention, the second partition wall 18 is formed at its generally central portion with an opening 30 which is kept closed under ordinary circumstance by a temperature sensitive valve means 32. The temperature sensitive valve means 32 comprises a generally cup-shaped valve holder 34 which is positioned within the chamber C and mounted on the second partition wall 18 so as to cover the opening 30. The cylindrical side wall adjacent to the open end of the valve holder 34 is formed with a plurality of apertures 36, and along the inner cylindrical surface adjacent to the longitudinal intermediate portion of the valve holder 34 there is formed an annular ridge 38. Within the cup-shaped valve holder 34 is positioned a domed bimetallic valve member 40 which has an annular base edge 42 firmly coupled into the annular ridge 38. The convex outer surface of the valve member 40 is arranged to sealably contact the opening portion 30 of the second partition wall 18. In this embodiment, the domed bimetallic valve member 40 is so constructed as to invert or take first and second states thereof in accordance with the temperature applied thereto in which the first state is a state to close the opening 30 as shown by real lines, and the second state is a state to open the opening 30 as shown by dotted lines. When heated to a predetermined temperature, the domed bimetallic valve member 40 changes its state or inverts from the first state to the second state thereby providing direct communication between the chamber B and the chamber C through the apertures 36.

With the above-stated construction of the alert device of the first embodiment of the present invention, the device operates as follows:

During normal operation of the engine, the temperature of the exhaust gases passing from the gas purifying device into the chamber B through the inlet tube 22 is relatively low, and the domed bimetallic valve member 40 remains in the first state in which the opening 30 is closed. Therefore, the exhaust gases from the inlet tube 22 are caused to travel, in turn, through the chamber B, the orifice 24, the chamber A, the elongated tube 26, the chamber C and the outlet tube 28, and thereafter emitted into the open air, as shown by arrows Y. Noises in the exhaust system are thus lost because the muffler acts in a normal manner. When the temperature of the exhaust gases from the gas purifying device is excessively high due to abnormal operation of the engine, the domed bimetallic valve member 40 takes the second state thereof shown by the dotted lines, in which the chamber B and the chamber C directly communicate through the apertures 36. The gases normally exhausted from the gas purifying device into the chamber B are thus introduced directly into the chamber C through the apertures 36 and, through the outlet tube 28, into the atmosphere or open air. Accordingly, the above-noted noise absorption is no longer provided and therefore a noticeably loud noise is generated. When the vehicle driver hears the noise he can acknowledge the abnormally high temperature condition of the exhaust gases and stop the vehicle. It is now to be appreciated that, in this embodiment, the apertures 36 can be so formed as to give a high-pitched tone even when a very small amount of exhaust gases are passed therethrough. Further, at least one whistle may be fixed to one of the apertures 36, if desired. Thus, the vehicle driver can quickly acknowledge the abnormal condition of the exhaust gases.

Figure 3A:
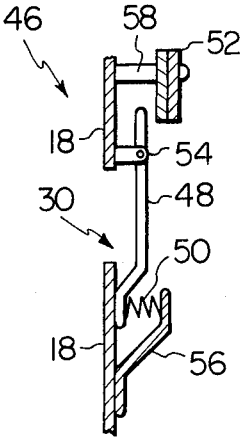
Figure 3B:
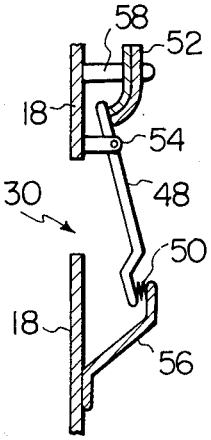

FIG. 3 shows two states of another temperature sensitive valve means 46, one of which is an open position (*a*) and the other is a closed position (*b*). This valve means 46 is fixed to the second partition wall 18 as a substitute for the valve means 32 of FIG. 1 and which generally comprises a damper door 48, a compression spring 50 and a bimetal strip 52. Adjacent to the opening 30 on the second partition wall 18, there is provided a support member 54 on which the one end portion of the damper door 48 is pivotally supported. The damper door 48 has sufficient surface area to close the opening 30. On the partition wall 18, opposite to the support member 54 with respect to the opening 30, there is firmly fixed a spring holder 56 for holding the spring 50 by which the other end portion of the damper door 48 is biased in a direction to close the opening 30. In this example, the other end portion of the damper door 48 is formed to be bent in order to provide the desired sealing function of the damper door 48 to the opening 30. Adjacent to the support member 54 is positioned the bimetal strip 52 which is supported on the second partition wall 18 through a relatively elongated support member 58 in such a manner that the free end thereof extends to reach the one end portion of the damper door 48 when heated. When heated to a predetermined temperature, the free end of the bimetal strip 52 urges the end portion of the damper door 48 thereby pivotally lifting the damper door against the biasing force of the spring 50, in a direction to open the opening 30.

Figure 4A:
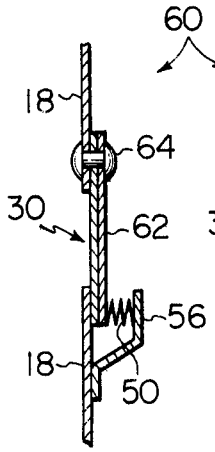
Figure 4B:
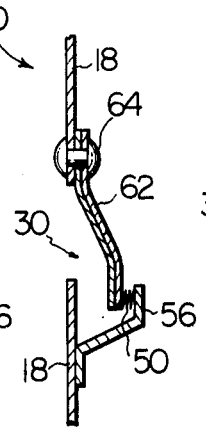

FIG. 4 shows another temperature sensitive valve means 60 which is similar to that of the FIG. 3 with the exception that it employs a damper door 62 made of a bimetallic material as a substitute for damper door 48 of FIG. 3. In this example, the bimetallic damper door 62 is connected at its one end portion to the second partition wall 18 by means of conventional fastening means such as rivets 64. The free end portion of the damper door 62 is biased toward the opening 30 by such a biasing means as described hereinbefore. When heated to the predetermined temperature, the free end portion of the damper door 62 is bent or flexed in a direction to open the opening 30 as shown in the FIG. 4(*b*). The direct communication between the chambers B and C is thus attained.

Figure 5A:
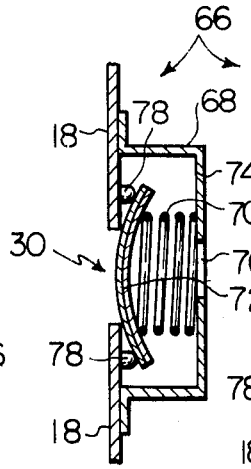
Figure 5B:
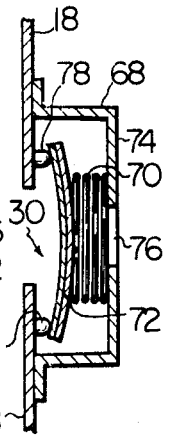

FIG. 5 shows the other temperature sensitive valve means 66 which generally comprises a cylindrical casing 68, a helical spring 70 and a normally convex bimetallic valve member 72. the cylindrical casing 68 has at its one end a bottom portion 74 formed with an opening 76, and is mounted on the second partition wall 18 so as to cover the opening 30. Surrounding the opening 30 of the second partition wall 18 are positioned a plurality of fulcrums 78 which are projected from the second partition wall 18 toward the inside of the cylindrical casing 68. The convex bimetallic valve member 72 is supported at its periphery by contact with the top portions of the fulcrums 78. In this instance, and under normal conditions, the convex bimetallic valve member 72 is arranged to seal the opening 30 with the convex outer surface thereof. Between the inner surface of the valve member 72 and the inner surface of the bottom portion 74 is disposed the helical spring 70 which is used for urging the convex bimetallic valve member 72 toward the opening 30. When the valve member 72 is heated to a predetermined level, it inverts to an open position thereof shown in FIG. 5(*b*) and therefore provides direct communication between the opening 30 and the other opening 76 with a result of direct communication between the chamber B and the chamber C. Although, in this example, the fulcrums 78 are projected from the second partition wall 18, it is also possible to provide a plurality of fulcrum projections on the peripheral portion of the valve member 72.

Referring to FIG. 6, there is shown the second embodiment of the alert device according to the present invention, in which a by-pass tube 80 is arranged to by-pass the muffler 82. At the inlet opening 84 of the by-pass tube 80, a temperature sensitive valve means which is one of the types hereinbefore described is fixed. In this embodiment, the valve means is a type of FIG. 4, wherein the bimetallic damper door 60 is mounted at the inlet portion of the tube 80 so as to open or close the opening 84 according to the temperature of exhaust gases from the exhaust purifying device (not shown). Accordingly, if the temperature of the gases from the purifying device is so high as to bend the bimetallic damper door 60, the by-passage is provided and the normal noise absorption of the muffler 82 is therefore prevented. Thus, the noticeably loud resonance noise is heard from the outlet tube 86.

It should be appreciated that the alert device according to the invention can also stop the abnormal rising of the exhaust gas temperature by itself without using other expensive safety apparatus, since the gases from the gas purifying device are more rapidly discharged into the open air when the valve means is in an open state.

It will be understood that the invention is not to be limited to the exact construction shown and described and that various changes and modifications may be made without departing from the spirit and scope of the invention, as defined in the appended claims.

What is claimed is:

1. A muffler, for a combustion engine, comprising:

a casing having therein first, second and third chambers which are respectively defined by first and second partition walls within said casing, said first partition wall having an opening for permitting flow of exhaust gases from said second to said first chamber, and said second partition wall having an opening for permitting flow of exhaust gases from said second chamber to said third chamber;

an inlet tube having one end opening into said second chamber for admitting exhaust gases, from a combustion engine, into said second chamber;

an elongated tube having opposite ends respectively opening into said first and third chambers for flowing exhaust gases therebetween;

an outlet tube having one end opening into said third chamber and the other end opening into an atmosphere externally of said casing for flowing exhaust gases out of said third chamber;

an invertible convex bimetallic valve member positioned to cover the opening through said second partition wall for normally closing the opening to prevent flow of exhaust gases through the opening and for inverting when sufficiently heated to open the opening and permit exhaust gases to flow from said second chamber into said third chamber through said opening;

a cylindrical casing having a bottom portion with an opening, said cylindrical casing being positioned within said third chamber and mounted on said second partition wall opposite the opening through said second partition wall to hold therein said invertible convex bimetallic valve member;

a plurality of fulcrums provided on said second partition wall surrounding the opening through said second partition wall and protruding toward said third chamber for supporting a peripheral portion of said convex bimetallic valve member; and a helical spring disposed between the inner surface of the convex bimetallic valve member and the inner surface of the bottom portion of said cylindrical casing for biasing said convex bimetallic valve member in a direction to sit on said plurality of fulcrums and close the opening of said second partition wall.

* * * * *